United States Patent [19]

Inoue et al.

[11] Patent Number: 4,836,914

[45] Date of Patent: Jun. 6, 1989

[54] METHOD FOR REMOVING IRON CONTENT IN PETROLEUM SERIES MINERAL OIL THEREFROM

[75] Inventors: Akira Inoue; Masaru Ushio, both of Yokohama; Toru Morita, Ayase; Yasuyuki Oishi; Hisao Sakoda, both of Yokohama, all of Japan

[73] Assignee: Nippon Oil Co., Ltd., Japan

[21] Appl. No.: 240,429

[22] Filed: Sep. 1, 1988

Related U.S. Application Data

[63] Continuation of Ser. No. 860,542, May 7, 1986, abandoned.

[30] Foreign Application Priority Data

May 8, 1985 [JP] Japan ..... 60-97367
May 8, 1985 [JP] Japan ..... 60-97368

[51] Int. Cl.[4] ..... C10G 45/04

[52] U.S. Cl. ..... 208/251 H; 208/251 R; 208/177; 423/140

[58] Field of Search ..... 208/251 R, 177, 251H; 423/140, 151

[56] References Cited

U.S. PATENT DOCUMENTS

| | | | |
|---|---|---|---|
| 2,607,492 | 8/1952 | Anders | 208/251 R |
| 3,696,032 | 10/1972 | Haensel | 210/695 |
| 3,767,571 | 10/1973 | Lorenc et al. | 210/695 |
| 3,923,643 | 12/1975 | Lewis et al. | 208/251 R |
| 4,278,539 | 7/1981 | Santhanam et al. | 423/140 |
| 4,298,456 | 11/1981 | Coombs et al. | 210/695 |
| 4,342,640 | 8/1982 | Lewis | 208/251 R |
| 4,388,179 | 6/1983 | Lewis | 208/251 R |
| 4,541,920 | 9/1985 | Seiuer | 208/251 R |
| 4,541,924 | 9/1985 | Rosensweig | 208/251 H |
| 4,588,507 | 5/1986 | Saudray et al. | 210/695 |

FOREIGN PATENT DOCUMENTS

| | | | |
|---|---|---|---|
| 2854949 | 7/1980 | Fed. Rep. of Germany | 210/695 |
| 2536088 | 5/1984 | France | 423/140 |
| 0067703 | 6/1978 | Japan | 208/251 R |
| 0030787 | 2/1982 | Japan | 208/251 R |
| 0101193 | 6/1983 | Japan | 208/251 H |
| 0973484 | 11/1982 | U.S.S.R. | 423/151 |

*Primary Examiner*—H.M. S. Sneed
*Assistant Examiner*—Helane Myers
*Attorney, Agent, or Firm*—Ostrolenk, Faber, Gerb & Soffen

[57] ABSTRACT

The present invention provides a method for removing an iron content in a petroleum series mineral oil therefrom which comprises treating a petroleum series mineral oil fraction containing 5 ppm or more of the iron content by the use of a high gradient magnetic separator under conditions of the strength of a magnetic field being from 500 to 25,000 gauss, a temperature being from room temperature to 400° C., and a linear velocity being 0.1 to 50 cm/second.

12 Claims, 1 Drawing Sheet

METHOD FOR REMOVING IRON CONTENT IN PETROLEUM SERIES MINERAL OIL THEREFROM

This is a continuation of application Ser. No. 860,542, now abandoned, filed on May 7, 1986.

BACKGROUND OF THE INVENTION (1) Field of the Invention

The present invention relates to a method for removing the iron content contained in a petroleum series mineral oil fraction.

(2) Description of the Prior Art

In the industrial field of petroleum refining, generally a crude oil is fractionated to separate it into a gasoline fraction, a kerosene fraction, a gas oil fraction and an atmospheric distillation residual oil fraction. These petroleum hydrocarbon fractions can be each refined to make petroleum products such as gasoline, kerosene, gas oil and fuel oil. A refining process which is now employed most usually is the so-called hydrogenation refining process in which hydrogen is allowed to react with the petroleum hydrocarbon fractions in the presence of a catalyst under a high pressure at a high temperature.

Impurities present in the petroleum fraction which is a raw material for the hydrogenation refining process contain or an extremely low concentration (e.g., 1 pmm or less) of iron content, when the petroleum fraction is a distillate fraction. However, the raw material distillates containing an iron content as much as 1 pmm or more are prepared on occasion, and some of such material oils contain 100 pmm or more of the iron content.

In many cases, such a material oil has a high acid value, and thus at least a part of the iron content contained therein can be considered to be that which is dissolved in the oil as a result of corrosion in a distilling plant, a storage tank for the distillate, oil transport pipes and the like by acidic materials present therein.

When such a material containing the higher iron content is treated by the hydrogenation refining process, a troublesome problem will occur in the operation of a refining plant. That is, since they are dissolved in the material oil, compounds containing the iron content are not caught by a filter disposed at an inlet of the plant, get into the plant, and reach the reactor which is an important portion of the plant, where the compounds are decomposed due to chemical reactions. The iron content is deposited in the form of sulfides between catalytic grains in the reactor and clog the reactor or to adhere to the surfaces of the catalytic grains, with the result that the power of a catalyst will be lowered. In the case that such a material oil is treated, the distilling plant, the distillate storage tank, the pipes and the like are manufactured with anti-corrosive materials, or alternatively the insides of these members may be subjected to a lining treatment with anti-corrosive materials, as known. In this measure, however, it is necessary to give the anticorrosion treatment to the huge storage tank and the long oil transport pipes, which increases costs.

As another process, a guard reactor is disposed upstream of the reactor in the hydrogenation refining plant.

In this arrangement, the material oil is introduced into a reactor which is called the guard reactor, where the iron content dissolved in the oil is decomposed by chemical reactions. The iron content is then changed into sulfides, and the latter are caught by a filler and catalytic grains with which the guard reactor is filled, and are deposited in the guard reactor.

The material oil from which the iron content has been removed in this way is caused to leave the guard reactor for the reactor.

According to this process, the clogging of the reactor and the deterioration in the used catalyst can be prevented, but the clogging of the guard reactor and the decline of the catalyst, by the iron compounds, with which the guard reactor is filled are unavoidable.

Still another process is composed of treating the distillate containing the iron content with an aqueous sodium hydroxide solution to neutralize the acidic materials present in the oil and extracting them into an aqueous solution.

In this process, the iron content is in the form of hydroxides or oxides, and the latter are transferred into the aqueous solution or are collected on each interface between the aqueous solution phase and the oil phase. This process is now utilized as a manner for extracting naphthenic acid from the petroleum fraction containing the acid. If the recovered naphthenic acid has any commercial value, the above mentioned process is advantageous.

However, this process is not practicable for a high-viscosity oil because of the difficulty of the separation between the oil phase and the aqueous solution phase and poor extraction of a naphthenate into the aqueous solution, although it is not impossible when a viscosity of the material oil fraction is low, for example, as in the case of a spindle oil fraction.

As still another process, the petroleum series mineral oil is brought into contact with hydrogen sulfide or ammonia in order to convert the iron content in the mineral oil into iron compounds which are insoluble in the oil, and the thus formed iron compounds are then removed by filtration, centrifugation or the like. However, particles deposited in the petroleum series mineral oil principally have a particle diameter of 10 microns or less, or a much small particle diameter than 1 micron on occasion. In consequence, the usual fine mesh filter cannot catch and remove such particles. One can consider making use of a membrane or a filter paper, but in the treatment of a great deal of the petroleum series mineral oil, such a material will be clogged with the particles to increase pressure and to break it, and additionally troublesome exchange is necessary. In short, such a material as the membrane or the filter cannot be employed on an industrial scale, though its employment is possible on a laboratory scale. Further, a method of using the technique of centrifugalization is also present, but it is not practicable either from the viewpoints of structure and operation.

On the other hand, the atmospheric distillation or the vacuum distillation residual oil contains, as the iron content, a large number of fine particles comprising iron and/or iron compounds. These iron particles are those which have come from a tank, pipes and a plant owing to erosion, when the crude oil is transported from a producing center by a tanker, is then stored in the tank, and is afterward delivered to the distilling plant via the oil transport pipes.

If such a distillation residual oil is used as the material oil for a fixed-bed type hydrogenation plant, the fine iron particles contained in the material oil will be deposited on the catalyst or between catalytic grains in a reactor, so that the latter will be clogged therewith or an activity of the catalytic grains will declined. Particularly, in the case of the clogging of the reactor, the pressure in the plant will be thereby increased, and at times, the operation of the plant must be stopped, which fact will give rise to an extremely large economical loss.

It is thus apparent that if the fine particles comprising the iron content are removed from the material oil, a great advantage will be obtained. However, such fine particles are as extremely small as about 0.1 to about 20 microns and thus cannot be removed by a filter which is generally employed in the petroleum refining industry.

In addition to the above mentioned techniques, several other processes for removing the fine particles can be enumerated. For example, a filter paper or a membrane having a fine mesh can be used as a filter. In the case that such a filter is employed, however, the pressure loss is very large, and clogging is liable to occur, which facts scarcely permit the filter to be used for a long period of time. In addition, since it is necessary that the old filter is exchanged for a new one, the manner of using the filter is indeed unsuitable for the treatment of a large amount of the material oil from the viewpoint of the operation.

Another method is characterized by the employment of centrifugalization, but it is poor in throughput in view of structure and operation and consequently is less practicable.

SUMMARY OF THE INVENTION

The inventors of the present application have intensively researched with the aim of solving the above mentioned problems, and as a result, it has been found that the iron content can be separated by the use of a high gradient magnetic separator, and what is better, the treating power is very high. On the basis of this finding, the present invention has been completed. That is, the present invention is directed to a method for removing the iron content in a petroleum series mineral oil which comprises treating a petroleum series mineral oil fraction containing 5 ppm or more of said iron content by the use of a high gradient magnetic separator under conditions of a magnetic field strength being from 500 to 25,000 gauss, a temperature from ordinary temperature to 400° C., and a linear velocity of 0.1 to 50 cm/second.

DETAILED DESCRIPTION OF THE INVENTION

Figure 1:
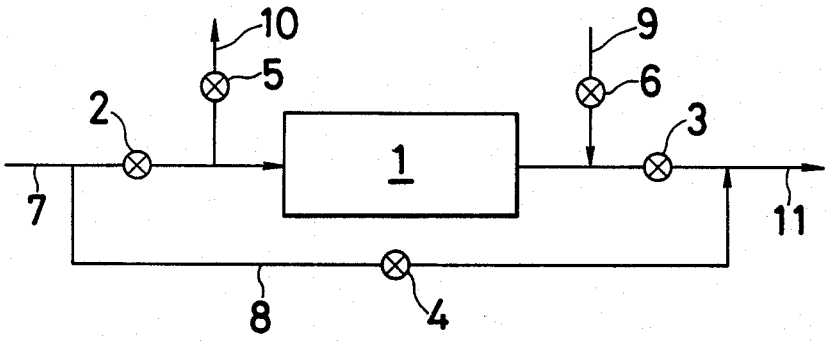
FIGS. 1 to 3 attached hereto are flow sheets illustrating methods of the present invention.

Materials used in the present invention are petroleum series mineral oils containing 5 ppm or more of iron content. This iron content means iron and/or compounds soluble in the mineral oil and fine particles of iron and/or iron compounds therein, as described above.

The petroleum series mineral oils to be treated by the present invention include a variety of petroleum series crude oils, various distillates obtained by distilling the crude oils under ordinary pressure or a reduced pressure, and these fractions which have been subjected to a solvent dewaxing treatment.

The present invention will be more useful, when relatively heavy fractions each having a 10% running point of 280° C. or more in terms of ordinary pressure are treated.

Further, the present invention is effective in the case that a distillate oil prepared by distillation is directly subjected to the treatment of the present invention without undergoing the above mentioned refining treatment.

The objects of the treatment by the present invention are the mineral oil fractions containing a small amount, for example, 1 pmm to a relatively large amount, e.g., about 500 ppm, in general, 5 to 200 ppm, of a soluble iron content.

Generally, some of the crude oils produced in South America contain the iron content in a relatively large amount, and thus the mineral oils from these materials can be treated effectively by the present invention.

Moreover, the petroleum series mineral oils used in the present invention include atmospheric or vacuum distillation residual oils prepared by an atmospheric or a vacuum distillation of various petroleum series crude oils, deasphaling oils of these fractions, and the like.

These distillation residual oils contain a great deal of impurities such as metals, for example, iron, nickel, vanadium; sulfur, nitrogen and/or asphaltene.

These distillation residual oils will be contaminated with fine particles comprising iron or iron compounds ($FeO$, $Fe_2O_3$ and the like) during transportation and storage. Such fine particles will be concentrated in the distillation residual oil, and the concentration of the iron fine particles in the residual oil will become as high as 10 to 100 wt ppm sometimes. The diameter of each fine particle ranges from 0.1 to 100 microns, but much of the fine particles have as small diameters as 20 microns or less.

A high gradient magnetic separator used in the present invention is a magnetic separator which is designed so as to separate paramagnetic fine particles from weak paramagnetic fine particles or diamagnetic fine particles. In the high gradient magnetic separator, a ferromagnetic filler is first placed in a uniform high magnetic field space, and a magnetic field is then generated therein so that a magnetic field gradient as high as $100\times10^3$ to $20{,}000\times10^3$ gauss/cm may occur usually around the filler, whereby the ferromagnetic or the paramagnetic fine particles are magnetically attracted on the surface of the filler. In this way, the ferromagnetic or the paramagnetic fine particles are separated from the other fine particles.

As the above mentioned ferromagnetic filler, there can be used a mass of ferromagnetic small-gage wires such as steel wool or steel net, each unit material of which usually has a diameter of 1 to 1,000 μm, or an expanded metal or steel beads. Above all, the expanded metal or the steel beads are preferred.

As the high gradient magnetic separators, there are an electromagnetic type in which the uniform high magnetic field is generated by an exciting coil, and a permanent magnet type in which the uniform high magnetic field is generated by a permanent magnet. An example of the electromagnet type high gradient magnetic separator is SALA-HGMS (registered trademark) manufactured and sold by Sala Magnetic Incorporated in U.S.A.

Now, a method of the present invention will be described.

The method for removing the iron content in a petroleum series mineral oil fraction by the use of a high gradient magnetic separator comprises introducing the mineral oil fraction into a magnetic field space in the high gradient magnetic separator and magnetically attracting the iron content by a ferromagnetic filler placed in the magnetic field space in order to remove the iron content therefrom.

Variables for the operation of the high gradient magnetic separator are a magnetic field strength, linear velocity and treatment temperature, and optimal conditions can be decided in compliance with the kind, size and concentration of iron particles to be magnetically attracted.

The magnetic field strength is the strength of the magnetic field in the space in which the filler is placed, and is usually within the range of 500 to 25,000 gauss, preferably 1,000 to 20,000 gauss.

The treatment temperature is the temperature of the oil at the time when it is introduced into the high gradient magnetic separator, and is usually within the range of room temperature to 400° C., preferably room temperature to 250° C.

Further, the above mentioned linear velocity is the linear velocity of the oil passing through the magnetic field space, and is usually within the range of 0.1 to 50 cm/second, preferably 0.2 to 20 cm/second.

The lower the magnetic properties of the particles to be separated are, and the smaller the particle size is, the lower the linear velocity must be.

The particle concentration means a concentration of iron compounds contained and suspended in the oil and is usually within the range of about 0.001 to 10 g/l.

On the other hand, a drum type magnetic separator, which has heretofore been used for the separation of relatively large ferromagnetic particles in the field of the magnetic mineral dressing of an iron ore, has a magnetic field strength of 500 gauss and a magnetic field gradient of about 500 gauss/cm, which are much smaller than those of the high gradient magnetic separation of the present invention. Such a drum type magnetic separator cannot be employed to separate the iron content having a diameter of about 0.1 to 20 microns in the petroleum series mineral oil fraction, though being able to achieve the separation of iron particles as foreign substances each having a large diameter with which a catalyst is contaminated due to the corrosion or the erosion of a plant.

In the present invention, the petroleum series mineral oil fraction from which the iron content has been separated and removed can be subjected to a fixed-bed type hydrogenation treatment.

The fixed-bed type hydrogenation treatment is a method for converting the material oil into a useful oil by allowing the material oil to react with hydrogen under a high pressure at a high temperature in the presence of a catalyst so as to carry out decomposition, desulfurization and demetallation reaction. In short, the fixed-bed type hydrogenation treatment means the combination of a direct desulfurization, hydrogenolysis and the like.

As the catalyst for the hydrogenation treatment, there can be used a catalyst in which a hydrogenated metal component comprising a metal or a metallic compound in the group VI and/or the group VII such as cobalt-molybdenum, nickel-molybdenum, nickel-tungsten, cobalt-molybdenum-nickel or platinum is supported on a porous carrier such as an activated alumina, silica-alumina or silica-magnesia catalyst.

With regard to the conditions for the hydrogenation treatment process, the reaction temperature is from about 300° to 480° C., reaction pressure is from about 50 to 200 kg/cm$^2$ (gauge), preferably from about 75 to 150 kg/cm$^2$ (gauge), liquid space velocity is about 0.1 to 10 HR$^{-1}$, preferably from about 0.2 to 4 HR$^{-1}$, and the ratio of hydrogen/oil is about from 100 to 2,000 Nl/l.

In the present invention, a gas containing hydrogen sulfide or a gas containing hydrogen sulfide and ammonia may be previously brought into contact with the petroleum series mineral oil fraction containing the iron content in order to convert the iron content contained therein into insoluble iron compounds, and the latter can be then separated and removed from the petroleum series mineral oil fraction by the use of the high gradient magnetic separator.

As the hydrogen sulfide gas and the ammonia gas used in the present invention, pure gases may be employed, but mixtures diluted with an inert gas such as hydrogen, nitrogen or methane may also be usable.

As the gas which will be brought into contact with the petroleum series mineral oil fraction in the present invention, an exhaust gas (an off-gas) usually obtained in a petroleum refining industry can be employed effectively.

That is, a catalytic hydrogenation refining process which is the most usual refining process for various petroleum hydrocarbon fractions serves to perform the hydrogenation of the mineral oil fraction, but in this case, sulfur and nitrogen of sulfur compounds and nitrogen compounds contained in the petroleum hydrocarbon fraction react with hydrogen under a high pressure at a high temperature in the presence of a catalyst. Then, they are discharged in the form of a hydrogen sulfide gas and an ammonia gas together with unreacted hydrogen and lower hydrocarbons from the hydrogenation refining reaction plant.

This gaseous mixture discharged from the hydrogenation refining reaction plant may be directly used as the mixed gas of the hydrogen sulfide gas and the ammonia gas effectively in the present invention. In addition, as this mixed gas, there can also be used a gas discharged at the time when the above reaction mixture from the reactor is subjected to a gas-liquid separation by the use of a high pressure separator and/or a low pressure separator. Further, a gas discharged in the case that the refined oil is stripped to expel the remaining gas can also be employed as the above mentioned mixed gas.

When concentrations of hydrogen sulfide and ammonia are within the range described above, the mixed gas can be, needless to say, used preferably, but the hydrogen sulfide gas and/or the ammonia gas can be additionally added to the above mentioned exhaust gas and then used.

The contact of the gas containing hydrogen sulfide or the gas containing hydrogen sulfide and ammonia with the petroleum series mineral oil fraction can be made by a gas-liquid mixing contact device such as a packed tower, a bubble-cap column or an orifice mixer, and with regard to a time necessary for the contact, a period of 1 to 120 minutes suffices.

A contact temperature is usually within the range of 10° to 300° C., preferably ordinary temperature to 200° C., and when it is in excess of this upper limit, the removal percentage will be decreased rather than increased.

An amount of the gas used for the contact in the present invention is such that hydrogen sulfide per gram atom of iron contained in the mineral oil to be treated is usually within the range of 1 to 1,000 mols, preferably 5 to 600 mols.

When the ammonia gas is mixed with hydrogen sulfide, an amount of the ammonia gas is usually ½ mol or less, preferably 1/5 to 1/1,000 mol per mol of the hydrogen sulfide gas. If the device having a high contact percentage is used, the amount of the used gas can be reduced correspondingly.

The mineral oil fraction containing the iron content is brought into contact with the gas containing hydrogen sulfide and ammonia at a temperature between 10° C. and 300° C. in order to convert the iron content into insoluble iron compounds and to thereby deposit and suspend them in the oil. These insoluble iron compounds contain a large amount of iron sulfides but will not be decomposed by acidic materials in the oil.

The diameter of each particle of the insoluble iron compounds is mainly 10 μm or less in a usual case, but at times, it is much smaller than 1 μm. Usually, the insoluble iron compounds are present in the suspending state in the oil.

Afterward, the insoluble iron compounds which are deposited and suspended in the oil are removed by means of the high gradient magnetic separator.

In the present invention, after the gas containing hydrogen sulfide or the gas containing hydrogen sulfide and ammonia has been contacted with the petroleum series mineral oil fraction, the treatment may be then carried out by the high gradient magnetic separator, followed by the fixed-bed type hydrogenation treatment.

Preferred embodiments of the present invention will be described in reference to accompanying drawings.

In FIG. 1, reference numeral 1 is a high gradient magnetic separator, numerals 2 to 6 are on-off valves, 7 to 11 are lines. Here, a petroleum series mineral oil fraction is introduced into the high gradient magnetic separator 1 through the line 7. At this time, the valves 4, 5 and 6 are closed and the valves 2 and 3 are opened. A portion of an iron content is magnetically attracted on a filler disposed in a magnetic field space in the high gradient magnetic separator 1.

When the operation is continued for a long period of time, the amount of the attracted iron content increases, so that the removal percentage of the iron content is lowered on occasion. In this case, the valves 2, 3 are closed, and the valve 4 is opened to by-pass the petroleum series mineral oil fraction. Afterward, the valves 5, 6 are opened, so that a washing oil is allowed to flow through the line 9 at an accelerated linear velocity, preferably at a speed ten times as high as at the treatment in a direction opposite to that at the time of the treatment, and immediately after this, the magnetic field is switched off. By this operation, the fine particles magnetically attracted by the filler are washed out and then discharged through the line 10. After a short period of time, the previous flowing state is re-established so as to restart the operation of the treatment.

Figure 2:
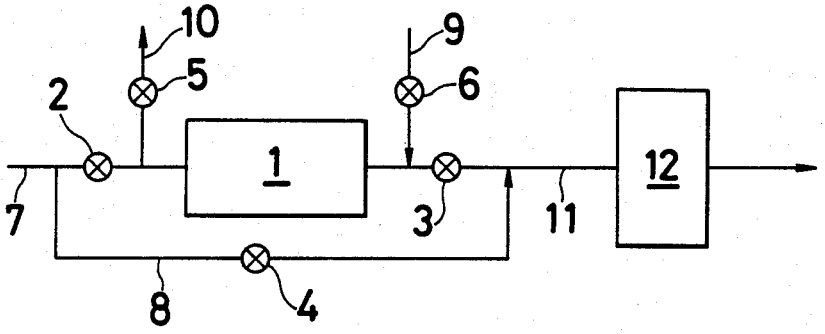

In FIG. 2, reference numeral 1 is a high gradient magnetic separator, numerals 2 to 6 are on-off valves, 7 to 11 are lines. Here, a petroleum series mineral oil fraction is introduced into the high gradient magnetic separator 1 through the line 7. At this time, the valves 4, 5 and 6 are closed and the valves 2 and 3 are opened. A portion of the iron content is magnetically attracted on a filler disposed in a magnetic field space in the high gradient magnetic separator 1, and the petroleum series mineral oil fraction in which the iron content has been diminished is delivered to a hydrogenation treatment device 12 through the line 11.

When the operation is continued for a long period of time, the amount of the magnetically attracted iron content increases on the filler in the separator 1, so that the removal percentage of the iron content is lowered on occasion. In this case, the valves 2, 3 are closed, and the valve 4 is opened to cause the petroleum series mineral oil fraction to bypass. Afterward, the valves 5, 6 are opened, so that a washing oil is allowed to flow through the line 9 at an accelerated linear velocity, preferably at a speed ten times as high as at the treatment in a direction opposite to that at the time of the treatment, and immediately after this, the magnetic field is switched off. By this operation, the fine particles magnetically attracted by the filler are washed out and then discharged through the line 10. After a short period of time, the previous flowing state is re-established so as to restart the operation of the treatment.

Figure 3:
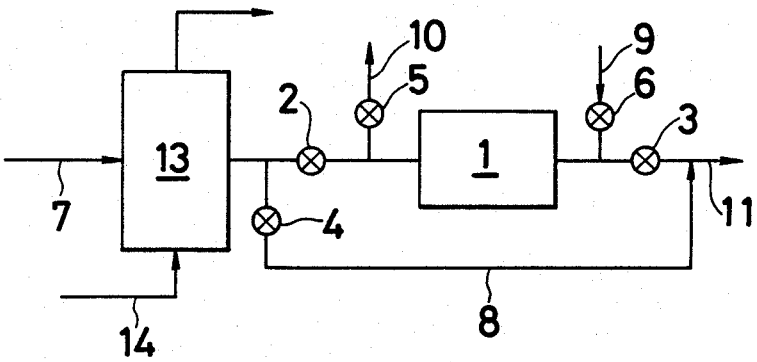

In FIG. 3, reference numeral 13 is a gas-oil contact device, numeral 1 is a high gradient magnetic separator, numerals 2 to 6 are on-off valves, 7 to 11 are lines. Here, a material oil introduced into the contact device 13 through a line 7 is brought into contact with a gas coming through a line 14 therein, so that insoluble iron compounds are deposited. Numeral 8 is a by-pass line, which is usually closed. The oil which has been brought into contact with the gas is delivered to the high gradient magnetic separator 1, and is then subjected to treatment. The deposited iron content and the other iron content are magnetically attracted on a filler disposed in a magnetic field space in the high gradient magnetic separator 1.

When the operation is continued for a long period of time, the amount of the magnetically attracted iron content increases on the filler in the separator 1, so that the removal percentage of the iron content is lowered on occasion. In this case, the valves 2, 3 are closed, and the valve 4 is opened to by-pass the petroleum series mineral oil fraction. Afterward, the valves 5, 6 are opened, so that a washing oil is allowed to flow through the line 9 at a relatively high linear velocity, preferably at a speed ten times as high as at the treatment in a direction opposite to that at the time of the treatment, and immediately after this, the magnetic field is switched off. The fine particles magnetically attracted by the filler are thereby washed out and then discharged together with the washing oil through the line 10. Afterward, the previous flowing state is re-established so as to restart the operation of the treatment.

The present invention will be described in detail in reference to examples.

EXAMPLE 1

By the use of an electromagnetic type high gradient magnetic separator "SALA-HGMS" (registered trademark), a petroleum series vacuum residual oil was treated under the following conditions:

| | |
|---|---|
| Magnetic field strength: | 20 kilogauss |
| Linear velocity: | 3.0 cm/sec |
| Temperature: | 150° C. |
| Filler: | Steel wool |

With regard to the thus treated oil and the material oil, iron contents were measured. The results are set forth in Table 1.

TABLE 1

| | Material oil | Treated oil |
|---|---|---|
| Iron content (wt ppm) | 30.0 | 8.3 |
| Removal percentage (%) | — | 72.3 |

The respective oils shown in Table 1 were subjected to a hydrogenation treatment by the use of a catalyst in which Mo, Co and Ni were supported on an alumina carrier, an amount of each component of Mo, Co and Ni being 5 wt. % based on the carrier. Conditions were as follows:

| | |
|---|---|
| Reaction temperature: | 400° C. |
| LHSV: | 0.3 $hr^{-1}$ |
| Partial pressure of hydrogen: | 120 $kg/cm^2$ |
| Reaction time: | 4,000 hours |

After the reaction, the catalyst and deposited substances were taken out from the upper portion, the middle portion and the lower portion of the reaction tower. Calcinating was then carried out, and the total Fe amount of the catalyst and the deposited substances in each portion was measured. The results are set forth in Table 2.

TABLE 2

| Charge stock | Material oil | Treated oil |
|---|---|---|
| Upper portion (wt %) | 11.5 | 2.1 |
| Middle portion (wt %) | 1.8 | 1.1 |
| Lower portion (wt %) | 0.7 | 0.5 |

The results set forth in Table 2 indicate that when the oil treated by the high gradient magnetic separator is used as the material, the amount of the iron on the catalystic bed in the upper portion of the reaction tower is decreased remarkably.

EXAMPLE 2

Commercially available iron naphthenate was dissolved in 70 pale of a fraction to prepare a material oil in which the iron content was 100 pmm.

As a contact treatment device, a packed tower was employed which had an inner diameter of 75 mm and a height of 2,000 mm, and as a filler, 5.0 liters of a percelain Raschig ring (10 mm in diameter) were employed.

The above mentioned material oil (feed rate 5 l/hr) at ordinary temperature was allowed to stream down from the top of the packed tower so as to accomplish a counter flow contact with an off-gas (feed rate 100 l-STP/hr) at ordinary temperature coming up from the bottom of the tower through a hydrogenation refining device under conditions of ordinary temperature and ordinary pressure, the aforesaid off-gas having the following composition. The material oil thus treated was afterward taken out from the tower through the bottom thereof.

| | |
|---|---|
| Hydrogen (vol %): | 73.8 |
| Hydrogen sulfide (vol %): | 2.1 |
| Ammonia (vol %): | 0.01 |
| Light saturated hydrocarbon (vol %) ($C_1$ to $C_4$): | 24.09 |

The thus treated oil was further treated by the use of SALA-HGMS (registered trademark) under the following conditions:

| | |
|---|---|
| Magnetic field strength: | 10 kilogauss |
| Linear velocity: | 10 cm/sec |
| Temperature: | Ordinary temperature |
| Filler in magnetic field space: | Steel wool |

COMPARATIVE EXAMPLE 1

The treated oil which was prepared in Example 2 was filtered through a No. 5 filter paper.

COMPARATIVE EXAMPLE 2

The treated oil which was prepared in Example 2 was centrifuged to separate solids in the oil therefrom.

The oils prepared in Example 2 and Comparative Examples 1 and 2 were then analyzed, and removal percentages were calculated from the concentrations of iron. The results are set forth in Table 3.

TABLE 3

| | Example | Comp. Ex. 1 | Comp. Ex. 2 |
|---|---|---|---|
| Iron content (ppm) | 25 | 28 | 32 |
| Removal percentage of iron content (%) | 75.0 | 72 | 68 |
| Total acid value (mg-KOH/g) | 0.22 | 0.23 | 0.22 |

EXAMPLE 3

A petroleum series vacuum residual oil was treated by the permanent magnet type high gradient magnetic separator under the following conditions:

| | |
|---|---|
| Magnetic field strength: | 1 kilogauss |
| Linear velocity: | 0.5 cm/sec |
| Temperature: | 250° C. |
| Filler: | Steel beads |

With regard to the thus treated oil and the material oil, iron contents were measured. The results are set forth in Table 4.

TABLE 4

| | Material oil | Treated oil |
|---|---|---|
| Iron content (wt ppm) | 42.0 | 17.0 |
| Removal percentage (%) | — | 59.5 |

The results in Table 4 indicate that the permanent magnet type high gradient magnetic separator can provide about the same removal effect of the iron content as in the case of the electromagnet type high gradient magnetic separator.

As described in Example 1, if the material oil is reacted without any treatment, much iron will be deposited in the upper portion of the catalyst bed in the reactor, so that clogging and increase in pressure will be caused. In consequence, stopping of the plant will be inevitable at times, and a large disadvantage will arise. According to the present invention, these troubles can be prevented, and the operation of the plant can be continued till the activity of the catalyst has passed away or as planned.

As seen in Table 3, the method of the present invention can provide the improved removal percentage of iron as compared with the comparative examples.

Further, in the method of the present invention, extremely rapid separation and removal are possible, and the treatment speed is several thousand times or more as high as that of the comparative examples.

What is claimed is:

1. A method for decreasing the pressure drop in a fixed bed hydrogenation plant which comprises treating an atmospheric or vacuum distillation residual oil containing 5 ppm or more of iron content by the use of a high gradient magnetic separator under conditions of the strength of the magnetic field being from 500 to 25,000 gauss, the temperature being from room temperature to 400° C., and the linear velocity being 0.1 to 50 cm/second, and thereafter hydrogenating said magnetically treated oil in a fixed-bed hydrogenation plant.

2. A method according to claim 1 wherein said oil is brought into contact with a gas containing hydrogen sulfide or a gas containing hydrogen sulfide and ammonia to convert the soluble iron content contained in said oil into insoluble iron compounds, and the latter are then treated by said high gradient magnetic separator.

3. A method according to claim 1 wherein said high gradient magnetic separator is an electromagnet separator or a permanent magnet separator.

4. A method according to claim 1 or 2 wherein said strength of the magnetic field is 1 to 20,000 gauss, the temperature is from room temperature to 250° C. and the linear velocity is 0.2 to 20 cm/second.

5. A method for decreasing the pressure drop in a fixed-bed hydrogenation plant which comprises treating an atmospheric or vacuum distillation residual oil containing 5 ppm or more of iron content by the use of a high gradient magnetic field under conditions of the strength of the magnetic field being from 500 to 25,000 gauss, the temperature being from room temperature to 400° C. and the linear velocity being 0.1 to 50 cm/second, and feeding said magnetically treated oil to a fixed-bed hydrogenation plant for the hydrogenation treatment.

6. A method according to claim 5 wherein said petroleum oil fraction is brought into contact with a gas containing hydrogen sulfide or a gas containing hydrogen sulfide and ammonia to convert the soluble iron content contained in said petroleum oil into insoluble iron compounds, and the latter are then treated by said high gradient magnetic separator.

7. A method according to claim 5 wherein said high gradient magnetic separator is an electromagnet separator or a permanent magnet separator.

8. A method according to claims 5 or 6 wherein said strength of the magnetic field is 1 to 10,000 gauss, the temperature is from room temperature to 250° C. and the linear velocity is 0.2 to 20 cm/second.

9. In a method of hydrogenating an atmospheric or vacuum distillation residual oil in a fixed-bed hydrogenation plant, the improvement which comprises employing as the hydrogenation reactor feed an atmospheric or vacuum distillation residual oil which, containing 5 ppm or more of iron content, was subjected to high gradient magnetic separator under conditions of the strength of the magnetic field being from 500 to 2500 gauss, the temperature being from room temperature to 400° C. and the linear velocity being 0.1 to 50 cm/second.

10. The method of claim 9 in which said distillation residual oil was contacted with a gas containing hydrogen sulfide or a gas containing hydrogen sulfide and ammonia to convert the soluble iron content contained in the distillation residual oil into insoluble iron compounds prior to treatment in said high gradient magnetic separator.

11. A method according to claim 9 in which said high gradient magnetic separator is an electromagnetic separator or a permanent magnet separator.

12. A method according to claims 9 or 10 wherein the strength of the magnetic field was 1 to 20,000 gauss, the temperature was from room temperature to 250° C. and the linear velocity was 0.2 to 20 cm/second.

* * * * *